US008967384B2

(12) United States Patent
Kingman et al.

(10) Patent No.: US 8,967,384 B2
(45) Date of Patent: Mar. 3, 2015

(54) SORTING MINED MATERIAL

(75) Inventors: Samuel Kingman, Burton on Trent (GB); Georgios Dimitrakis, Nottingham (GB); Christopher Dodds, Nottingham (GB)

(73) Assignee: Technological Resources Pty Ltd, Melbourne, Victoria (AU)

( * ) Notice: Subject to any disclaimer, the term of this patent is extended or adjusted under 35 U.S.C. 154(b) by 0 days.

(21) Appl. No.: 13/517,460

(22) PCT Filed: Dec. 21, 2010

(86) PCT No.: PCT/AU2010/001712

§ 371 (c)(1),
(2), (4) Date: Nov. 27, 2012

(87) PCT Pub. No.: WO2011/075768

PCT Pub. Date: Jun. 30, 2011

(65) Prior Publication Data

US 2013/0062264 A1 Mar. 14, 2013

(30) Foreign Application Priority Data

Dec. 21, 2009 (AU) ..... 2009906187

(51) Int. Cl.

| | |
|---|---|
| ***B03B 9/06*** | (2006.01) |
| ***B07C 5/342*** | (2006.01) |
| ***B07C 5/36*** | (2006.01) |

(52) U.S. Cl.

CPC ..... *B07C 5/342* (2013.01); *B07C 5/363* (2013.01)

USPC ..... 209/11; 209/4; 374/10; 374/100; 374/112; 204/157.15

(58) Field of Classification Search

USPC ..... 209/4, 11, 576, 577; 374/10, 100, 112

See application file for complete search history.

(56) References Cited

U.S. PATENT DOCUMENTS

| | | | | |
|---|---|---|---|---|
| 5,024,740 | A * | 6/1991 | Birken et al. | 204/157.15 |
| 5,141,110 | A * | 8/1992 | Trischan et al. | 209/524 |
| 5,161,695 | A * | 11/1992 | Roos | 209/11 |
| 6,522,149 | B2 * | 2/2003 | Yokoyama et al. | 324/453 |
| 8,820,533 | B2 * | 9/2014 | Shaw et al. | 209/3 |
| 2011/0147277 | A1 * | 6/2011 | Harding et al. | 209/4 |
| 2013/0020420 | A1 * | 1/2013 | Shaw et al. | 241/1 |

FOREIGN PATENT DOCUMENTS

| | | |
|---|---|---|
| GB | 2 188 727 A | 10/1987 |
| WO | WO 97/29843 | 8/1997 |
| WO | WO 2007/051225 A1 | 5/2007 |

OTHER PUBLICATIONS

International Search Report issued by the Australian Patent Office in International Application No. PCT/AU2010/001712, mailed Feb. 23, 2011 (3 pages).

(Continued)

*Primary Examiner* — Terrell Matthews
(74) *Attorney, Agent, or Firm* — Banner & Witcoff, Ltd.

(57) ABSTRACT

A method of sorting mined material, such as mined ore, is disclosed. The method comprises exposing particles of mined material to radio frequency electromagnetic radiation and heating particles depending on the minerals present in the particles and then thermally analyzing particles exposed to radio frequency electromagnetic radiation to detect temperature differences between particles which indicate differences in the minerals in the particles. The method also comprises sorting the particles on the basis of the results of the thermal analysis.

17 Claims, 1 Drawing Sheet

(56) References Cited

OTHER PUBLICATIONS

International Preliminary Report on Patentability issued by the Australian Patent Office in International Application No. PCT/AU2010/001712, dated Mar. 23, 2012 (3 pages).

Daniel Bennett, et al., "Quantitative measurement of copper mineralogy using magnetic resonance", Minerals Engineering, vol. 20, pp. 1344-1350 (2007).

Daniel Bennett, et al., "The measurement of chalcopyrite content in rocks and slurries using magnetic resonance", Minerals Engineering, vol. 22, pp. 821-825 (2009).

* cited by examiner

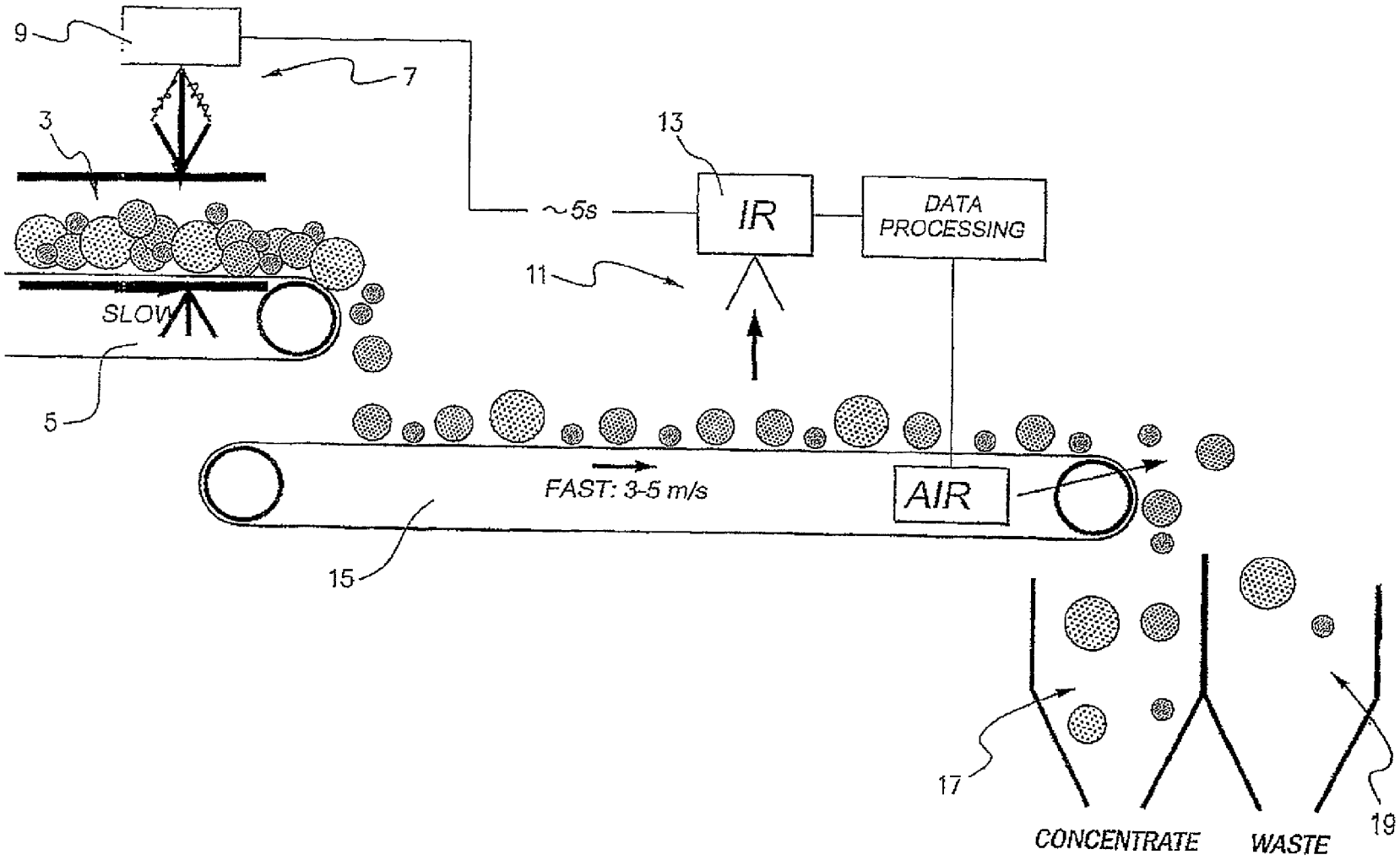
DATA PROCESSING
IR
AIR
SLOW
FAST: 3-5 m/s
~5s
CONCENTRATE
WASTE
3
5
7
9
11
13
15
17
19

SORTING MINED MATERIAL

CROSS REFERENCE TO RELATED APPLICATIONS

This application is a national phase application based on PCT/AU2010/001712, filed Dec. 21, 2010, and claims the priority of Australian Application No. 2009906187, filed Dec. 21, 2009, the content of both of which is incorporated herein by reference.

The present invention relates to the use of radio frequency electromagnetic radiation to facilitate sorting mined material.

The term "radio frequency electromagnetic radiation" is understood herein to mean electromagnetic radiation that has frequencies in the range of 1-100 MHz.

In particular, although by no means exclusively, the present invention provides a method of sorting minerals, such as sulphide minerals, such as chalcopyrite and pyrite, which exhibit very similar heating responses when exposed to microwave frequency electromagnetic radiation that has been proposed previously as a basis for sorting mined material. In this context, the present invention provides an opportunity to discriminate between valuable and non-valuable minerals. In addition, in this context, the present invention also provides an opportunity to assess the relative amounts of valuable and non-valuable minerals in ore particles and to use this information as a basis to sort particles.

The mined material may be any mined material that contains valuable material, such as valuable metals. Examples of valuable materials are valuable metals in minerals such as minerals that comprise metal oxides or metal sulphides. Specific examples of valuable materials that contain metal oxides are iron ores. Specific examples of valuable materials that contain metal sulphides are copper-containing ores. Another example of a valuable material is salt.

The term "mined" material is understood herein to include (a) run-of-mine material and (b) run-of-mine material that has been subjected to at least primary crushing or similar size reduction after the material has been mined and prior to being sorted.

A particular area of interest to the applicant is mined material in the form of mined ores that include minerals such as chalcopyrite that contain valuable metals, such as copper, in sulphide forms.

Different sulphide minerals are often found in nature intimately located together. A particular example is chalcopyrite ($CuFeS_2$) and pyrite ($FeS_2$) which are often found together in the same mineral grains. Due to the very small grain sizes that occur it is often very difficult to identify such phases and/or separate them from each other or from other parts of the mined material.

There have been proposals to use microwave frequency electromagnetic radiation as a basis for sorting particles containing copper-containing minerals, such as chalcopyrite, from less valuable particles, such as particles containing pyrite. International publication WO 2007/051225 in the name of The University of Queensland is one example of such a proposal. However, the inventors have found that microwave radiation is not an effective option for disciminating between chalcopyrite and pyrite. Chalcopyrite and pyrite absorb microwave radiation and have very similar heating responses (10-100 degrees C./s) when exposed to microwave radiation. The heating rates of chalcopyrite and pyrite are significantly greater than most rock-forming minerals associated with chalcopyrite and pyrite at microwave frequencies. These host rocks can be regarded as microwave transparent host rocks. Hence, whilst heating rate can be used to identify chalcopyrite and pyrite from these microwave transparent host rocks (as a basis of a sorting method), the use of microwave frequencies (100 MHz-10 GHz) is not able to discriminate such chalcopyrite and pyrite minerals from each other. This is an issue given the significant difference in economic value between chalcopyrite and pyrite.

The above description is not to be understood as an admission of the common general knowledge in Australia or elsewhere.

The present invention is based on a realization that when mined material that contains metal sulphide minerals, specifically copper-containing minerals, is exposed to radio frequency electromagnetic radiation (i.e. frequencies of 1-100 MHz), the minerals exhibit significantly different heating properties, including heating rates, which can be used as a method of sorting such mined material.

The present invention is also based on a realization that when mined material that contains metal oxide minerals, specifically iron ores, is exposed to radio frequency electromagnetic radiation, the minerals exhibit significantly different heating properties, including heating rates, which can be used as a method of sorting such mined material.

Experimental work on which the present invention is based has shown that the present invention enables minerals to be identified based on the thermal signatures of the minerals as a function of loss factor in a given electric field, where "loss factor" is understood herein to be an indication of the ability of the minerals to convert stored energy to heat. The inventors have found that at low frequencies, i.e. in the radio frequency band, conduction is the major heating mechanism, and metal oxide and metal sulphide minerals exhibit different conductivities and are able to be heated at different rates and, therefore, can be identified selectively in very short periods of time (<<1 s) and to very high resolution.

In the context of sorting ores containing copper minerals, the present invention not only enables particles containing metal sulphide minerals (with valuable and non-valuable metals) to be identified but also enables particles containing specific metal sulphide minerals such as chalcopyrite and other copper-containing sulphide minerals to be located. In other words, the present invention makes it possible to discriminate between specific metal sulphide minerals.

In some situations the present invention may make it possible to relate the temperature increase to the grade of a valuable metal in an individual rock.

The present invention also relates to a method and an apparatus for recovering valuable material, such as valuable metals, from mined material that has been sorted as described above.

The present invention is particularly, although not exclusively, applicable to sorting low grade mined material.

The term "low" grade is understood herein to mean that the economic value of the valuable material, such as a metal, in the mined material is only marginally greater than the costs to mine and recover and transport the valuable material to a customer.

In any given situation, the concentrations that are regarded as "low" grade will depend on the economic value of the valuable material and the mining and other costs to recover the valuable material at a particular point in time. The concentration of the valuable material may be relatively high and still be regarded as "low" grade. This is the case with iron ores.

In the case of valuable material in the form of copper sulphide minerals, currently "low" grade ores are run-of-mine ores containing less than 1.0% by weight, typically less than 0.6 wt. %, copper in the ores. Sorting ores having such low concentrations of copper from barren particles is a challenging task from a technical viewpoint, particularly in situations where there is a need to sort very large amounts of ore, typically at least 10,000 tonnes per hour, and where the barren particles represent a smaller proportion of the ore than the ore that contains economically recoverable copper.

The term "barren" particles, when used in the context of copper-containing ores, are understood herein to mean particles containing minerals with no copper (such as pyrite) or very small amounts of copper that can not be recovered economically from the particles.

The term "barren" particles when used in a more general sense in the context of valuable materials is understood herein to mean particles with no valuable material or amounts of valuable material that can not be recovered economically from the particles.

According to the present invention there is provided a method of sorting mined material, such as mined ore, comprising the steps of:

(a) exposing particles of mined material to radio frequency electromagnetic radiation and heating particles depending on the minerals present in the particles;

(b) thermally analysing particles exposed to radio frequency electromagnetic radiation in step (a) to detect temperature differences between particles which indicate differences in the minerals in the particles; and (c) sorting the particles on the basis of the results of the thermal analysis.

The basis of thermal analysis in step (b) may be that mined material that contains particles that have higher levels of valuable minerals, such as chalcopyrite, respond differently thermally to more barren particles, i.e. particles with no or uneconomically recoverable concentrations of valuable materials, such as pyrite, when exposed to radio frequency electromagnetic radiation to an extent that the different thermal responses can be used to as a basis to sort particles.

More particularly, step (a) may comprise selecting an exposure time for particles to radio frequency electromagnetic radiation and/or the electric field strength of the radio frequency electromagnetic radiation having regard to different heating properties of minerals in the mined material, such as chalcopyrite and pyrite in situations where mined material contains these minerals, to facilitate discriminating between the minerals in thermal analysis step (b).

Step (a) may comprise exposing particles of mined material to radio frequency electromagnetic radiation for less than 0.1 seconds, typically less than 0.01 seconds, and more typically less than 0.001 seconds.

Step (a) may comprise exposing particles of mined material to radio frequency electromagnetic radiation and creating a power density of at least $1\times10^7$ W/m$^3$ in minerals that have the highest loss factor in the mined material. In the case of mined material containing chalcopyrite, typically chalcopyrite is the highest loss mineral.

Step (a) may comprise using pulsed or continuous radio frequency electromagnetic radiation.

According to the present invention there is also provided an apparatus for sorting mined material, such as mined ore, comprising:

(a) a radio frequency electromagnetic radiation treatment station for exposing particles of mined material to radio frequency electromagnetic radiation;

(b) a thermal analysis station for detecting thermal differences between particles from the radio frequency electromagnetic radiation treatment station that indicate differences in the minerals in the particles that can be used as a basis for sorting particles; and (c) a sorter for sorting the particles on the basis of the thermal analysis.

The apparatus may comprise an assembly, such as a conveyor belt or belts, for transporting the particles of the mined material from the radio frequency electromagnetic radiation treatment station to the thermal analysis station.

According to the present invention there is also provided a method for recovering valuable material, such as a valuable metal, from mined material, such as mined ore, comprising sorting mined material according to the method described above and thereafter processing the particles containing valuable material and recovering valuable material.

The present invention is described further by way of example with reference to the accompanying drawing which is a schematic diagram which illustrates one embodiment of a sorting method in accordance with the present invention.

The embodiment is described in the context of a method of recovering a valuable metal in the form of copper from low grade copper-containing ores in which the copper is present as chalcopyrite and the ores also contain a non-valuable metal sulphide in the form of pyrite. The objective of the method in this embodiment is to identify chalcopyrite and pyrite minerals. In situations where the chalcopyrite and pyrite minerals are in separate particles, the minerals can be separated into two streams. The separated chalcopyrite particles can then be processed as required to recover copper from the particles. Separating the chalcopyrite particles and the pyrite particles prior to the downstream recovery steps significantly increases the average grade of the material being processed in these steps. In situations where the chalcopyrite and pyrite minerals are in the same particles, the ratio of gangue to chalcopyrite to pyrite for each particle can be determined so that an "intelligent" decision regarding the net economic worth of that particle can be made. For example, if a particle has a lot of chalcopyrite but a lot of pyrite as well, the net cost of extracting the copper given the pyrite content may push the net value below the prevailing threshold. Alternatively particles with high copper and high pyrite could be separated into a new stream for blending or extraction using a more conducive approach (e.g. leaching).

It is noted that the present invention is not confined to these ores and to copper as the valuable material to be recovered. In general terms, the present invention provides a method of sorting any minerals which exhibit very different heating responses, typically heating rates, when exposed to radio frequency electromagnetic radiation.

Heating results primarily from conduction losses (as in the case of sulphide minerals) through the redistribution of charge which leads to surface currents under the influence of the externally applied electric field. As frequency is reduced, for materials with a reasonable value of conductivity (i.e. $\gg 1$ Sm$^{-1}$) the conduction loss mechanism becomes more important, to the point where the material can be classed not as a dielectric but as a conductor.

The inventors have found that chalcopyrite and pyrite minerals have very different values of conductivity at lower frequencies (such as radio frequencies) and, as a consequence can be heated far more selectively at lower frequencies than at higher frequencies (such as microwave frequencies) because conductivity is a more significant heating mechanism at lower frequencies.

More particularly, the inventors have found that at lower frequencies (such as radio frequencies) chalcopyrite and pyrite minerals behave more as conductors, whilst at higher frequencies (such as microwave frequencies) the materials still conduct, but less so, and behave more like dielectric materials.

The inventors have found that chalcopyrite and pyrite have up to several orders of magnitude difference in loss factor at lower frequencies that makes very high degrees of heating selectivity possible, thereby enabling chalcopyrite and pyrite to be identified as separate minerals and then sorted from each other based on the thermal signatures of the minerals.

The inventors have also found that the difference in heating rates (or selectivity) of chalcopyrite and pyrite increases with an increase in the electric field strength. Consequently, it is possible to operate with high electric field strengths for short time periods and obtain thermal signatures that allow sorting of chalcopyrite and pyrite. This is an advantage because rapid heating for a short time period minimises heat transfer through conduction from one mineral phase to the next mineral phase that may have an impact on the localised thermal response.

With reference to the drawing, a feed material in the form of ore particles 3 that have been crushed by a primary crusher (not shown) to a particle size of 10-25 cm are supplied via a conveyor 5 (or other suitable transfer means) to a radio frequency electromagnetic radiation treatment station 7 and are moved past a radio frequency electromagnetic radiation assembly that comprises a generator 9 and a pair of parallel plates and exposed to radio frequency electromagnetic radiation, either in the form of continuous or pulsed radiation.

It is noted that the term "particle" as used herein may be understood by some persons skilled in the art to be better described as "fragments". The intention is to use both terms as synonyms.

The radio frequency electromagnetic radiation causes localised heating of particles depending on the minerals in the particles. In particular, the particles are heated to different extents depending on the minerals in the particles. As is indicated above, the inventors have found that particles having relatively small concentrations of chalcopyrite, typically less than 0.5 wt. %, are heated to a greater extent than pyrite by radio frequency electromagnetic radiation. This is a significant finding in relation to low grade ores because of the difficulty in discriminating between chalcopyrite and pyrite using microwave frequency electromagnetic radiation that has been proposed as a basis of sorting ores.

The basis of thermal analysis in this embodiment is that particles that contain chalcopyrite will become hotter than particles containing pyrite, i.e. barren particles, only when exposed to radio frequency electromagnetic radiation.

The particles can be formed as a relatively deep bed on the conveyor belt 5. The bed depth and the speed of the belt and the power of the radio frequency electromagnetic radiation generator and the frequency of the radio frequency electromagnetic radiation are inter-related.

The key requirement is to enable sufficient exposure of the particles to radio frequency electromagnetic radiation to heat the minerals in the particles to an extent required to allow the chalcopyrite particles to be distinguished thermally from barren particles. Whilst it is not always the case, typically the barren particles comprise material that is not heated significantly, if at all, when exposed to radio frequency electromagnetic radiation. Typically, the operating conditions are selected so that particles are exposed to high electric field strengths for short time periods, considerably less than 1 second.

The particles that pass through the radio frequency electromagnetic radiation treatment station 7 drop from the end of the conveyor belt 5 onto a lower conveyor belt 15 and are transported on this belt through an infra-red radiation detection station 11 at which the particles are viewed by an infrared camera 13 (or other suitable thermal detection apparatus) and are analysed thermally. The conveyor belt 15 is operated at a faster speed than the conveyor belt 5 to allow the particles to spread out along the belt 15. This is helpful in terms of the downstream processing of the particles.

The spacing between the stations 7 and 11 is selected having regard to the belt speed to allow sufficient time, typically at least 5 seconds, for the particles to be heated uniformly within each particle.

Advantageously, the upstream processing conditions are selected so that the particles have sufficient retained heat for thermal analysis without additional heating of the particles being required. If additional heating is required, it can be provided by any suitable means.

In one mode of operation the thermal analysis is based on distinguishing between particles that are above and below a threshold temperature. The particles can then be categorised as "hotter" and "colder" particles. The temperature of a particle is related to the amount of copper minerals in the particle. Hence, particles that have a given particle size range and are heated under given conditions will have a temperature increase to a temperature above a threshold temperature "x" degrees if the particles contain at least "y" wt. % copper. The threshold temperature can be selected initially based on economic factors and adjusted as those factors change. Barren particles will generally not be heated on exposure to microwave energy to temperatures above the threshold temperature.

Once identified by thermal analysis, the hotter particles are separated from the colder particles and the hotter particles are thereafter processed to recover copper from the particles. Depending on the circumstances, the colder particles may be processed in a different process route to the hotter particles to recover copper from the colder particles.

The particles are separated by being projected from the end of the conveyor belt 15 and being deflected selectively by compressed air jets (or other suitable fluid jets, such as water jets) as the particles move in a free-fall trajectory from the belt 15 and thereby being sorted into two streams 17, 19. In this connection, the thermal analysis identifies the position of each of the particles on the conveyor belt 15 and the air jets are activated a pre-set time after a particle is analysed as a particle to be deflected.

Depending on the particular situation, the gangue particles may be deflected by air jets or the particles that contain copper above a threshold concentration may be deflected by air jets.

The hotter particles become a concentrate feed stream 17 and are transferred for downstream processing, typically including milling, flotation to form a concentrate, and then further processing to recover copper from the particles.

The colder particles may become a by-product waste stream 19 and are disposed of in a suitable manner. This may not always be the case. The colder particles have lower concentrations of copper minerals and may be sufficiently valuable for recovery. In that event the colder particles may be transferred to a suitable recovery process, such as leaching.

One further option is to assess the particles a second time to get a fuller profile of the particles. For example, the chalcopyrite exposed to radio frequency electromagnetic radiation heat rapidly and manifests as a radio frequency electromagnetic radiation plume on the surface quite quickly (quantitative chalcopyrite flag) while the energy from the pyrite which heats slower takes a longer time to report to the surface and would present a little later (quantitative pyrite flag). The eventual temperature of a given particle at steady state is the total pyrite and chalcopyrite contents, which could therefore be used together with the other results to estimate the copper grade and ratios upon which an informed/intelligent decision can be made as to whether the particle can be processed economically to recover copper from the particle.

Features of the above-described method and apparatus include the following features in relation to the use of microwave frequency electromagnetic radiation proposed previously.

Better penetration than microwave frequency electromagnetic radiation—makes it possible to treat larger particles.

Better engineering and control options, particularly in mining applications operating at large throughputs, such as at least 10,000 tonnes per hour. In particular, more uniform field, simpler applicator design (such as two parallel plates), easier to contain energy, higher power off-the-shelf apparatus, better control with varying load Provision for intelligent sorting in which particles could be sorted according to the most appropriate recovery process based on their gangue:desirable mineral; undesirable mineral ratios.

Many modifications may be made to the embodiment of the present invention described above without departing from the spirit and scope of the present invention.

By way of example, whilst the above description of an embodiment of the invention focuses on copper sulphide minerals, particularly chalcopyrite, the present invention is not limited to these minerals and extends to ores containing valuable metals generally. By way of example, the present invention extends to valuable materials in the form of iron ores.

The invention claimed is:

1. A method of sorting mined material comprising the steps of:

(a) exposing particles of mined material to radio frequency electromagnetic radiation and heating particles depending on the minerals present in the particles, by the exposure to radio frequency electromagnetic radiation;

(b) thermally analysing particles exposed to radio frequency electromagnetic radiation in step (a) to detect temperature differences between particles which indicate differences in the minerals in the particles; and (c) sorting the particles on the basis of the results of the thermal analysis.

2. The method defined in claim 1, wherein thermal analysis step (b) comprises thermally analysing particles exposed to radio frequency electromagnetic radiation in step (a) to detect temperature differences between particles which indicate particles having higher levels of valuable minerals than more barren particles, i.e. particles having no or economically recoverable concentrations of valuable minerals.

3. The method defined in claim 1, wherein thermal analysis step (b) comprises thermally analysing particles exposed to radio frequency electromagnetic radiation in step (a) to identify particles that are above or below a threshold temperature, with the threshold temperature being selected such that particles above the threshold temperature have higher levels of valuable minerals than more barren particles, i.e. particles having no or economically recoverable concentrations of valuable minerals, and particles below the threshold temperature have higher levels of barren particles.

4. The method defined in claim 1, wherein step (a) comprises selecting an exposure time for particles to radio frequency electromagnetic radiation and/or an electric field strength having regard to the different heating properties of minerals in the mined material to facilitate discriminating between the minerals in thermal analysis step (b).

5. The method defined in claim 4, wherein the heating properties of minerals in the mined material comprise heating rates of minerals.

6. The method defined in claim 1, wherein step (a) comprises exposing particles of mined material to radio frequency electromagnetic radiation for less than 0.1 second.

7. The method defined in claim 1, wherein step (a) comprises exposing particles of mined material to radio frequency electromagnetic radiation for less than 0.01 second.

8. The method defined in claim 1, wherein step (a) comprises exposing particles of mined material to radio frequency electromagnetic radiation for less than 0.001 second.

9. The method defined in claim 1, wherein step (a) comprises exposing particles of mined material to radio frequency electromagnetic radiation and creating a power density of at least $1\times10^7$ W/m$^3$ in minerals that have the highest loss factor in the mined material.

10. The method defined in claim 1, wherein step (a) comprises using pulsed or continuous radio frequency electromagnetic radiation.

11. The method defined in claim 1, wherein the mined material contains metal sulphide minerals.

12. The method defined in claim 11, wherein the metal sulphide minerals comprise copper-containing minerals.

13. The method defined in claim 12, wherein the copper-containing minerals comprise chalcopyrite.

14. The method defined in claim 13, wherein the mined material also comprises pyrite.

15. The method defined in claim 14, wherein sorting step (c) comprises sorting particles that are above or below a threshold temperature into separate streams, with the threshold temperature being selected such that one stream comprises particles having economically recoverable levels of chalcopyrite and one stream comprises pyrite particles.

16. The method defined in claim 12, wherein the copper-containing minerals contain less than 1 wt. % copper.

17. A method for recovering valuable material from mined material comprising sorting mined material according to the method defined in claim 1, and obtaining at least one stream comprising the valuable material and thereafter processing the stream comprising the valuable material and recovering the valuable material.

* * * * *